United States Patent [19]

Murakami et al.

[11] 4,178,750

[45] Dec. 18, 1979

[54] CONTROL CIRCUIT FOR ELECTRONIC TIMEPIECE

[75] Inventors: Tomomi Murakami, Higashiyamato; Singo Ichikawa, Sayama, both of Japan

[73] Assignee: Citizen Watch Company Limited, Japan

[21] Appl. No.: 839,259

[22] Filed: Oct. 4, 1977

[30] Foreign Application Priority Data

Oct. 6, 1976 [JP] Japan ..... 51-119977
Oct. 6, 1976 [JP] Japan ..... 51-119978

[51] Int. Cl.[2] ..... G04B 19/24; G04C 3/00; G04C 9/00

[52] U.S. Cl. ..... 58/4 A; 58/23 R; 58/38 R; 58/39.5; 58/50 R; 58/57.5; 58/58; 58/85.5

[58] Field of Search ..... 58/4 A, 23 R, 38 R, 58/39.5, 50 R, 57.5, 58, 74, 85.5, 152 R, 152 B

[56] References Cited

U.S. PATENT DOCUMENTS

| | | | |
|---|---|---|---|
| 3,953,964 | 5/1976 | Suppa et al. | 58/50 R |
| 4,044,544 | 8/1977 | Yagi et al. | 58/23 R |
| 4,084,401 | 4/1978 | Belardi et al. | 58/4 A |
| 4,089,159 | 5/1978 | Yoshida | 58/152 R |

*Primary Examiner*—Stanley J. Witkowski

[57] ABSTRACT

A control circuit for an electronic timepiece in which a digit selection switch is connected to a timer circuit which generates an output signal only when the digit selection switch is actuated for a given interval of time. An output signal generation means is coupled to the timer circuit and rendered operative in response to the output signal from the timer circuit to generate an output pulse. A digit selection circuit is responsive to the output pulse from the output signal generation circuit for selecting a digit to be corrected in a timekeeping circuit. The output signal generation circuit comprises a first means responsive to the output signal from the timer circuit and a second means normally inhibited by the first means and rendered operative when the first means has been set by the output signal from the timer circuit, whereby a time correction mode is selected under a circumstance in which the digit selection switch is continuously actuated for the given period of time and, thereafter, a digit to be corrected is selected each time the digit selection switch is actuated. The timepiece has a number of function display marks corresponding to respective functions, and a display device is arranged so as to permit a display of function display marks corresponding to the functions which have been placed in selected state.

9 Claims, 6 Drawing Figures

CONTROL CIRCUIT FOR ELECTRONIC TIMEPIECE

BACKGROUND OF THE INVENTION

This invention relates to an improvement in a correction and control system which is made use of in a function-equipped timepiece.

In digital electronic timepieces which make use of a quartz oscillator and comprise C-MOS circuitry and an electro-optical display device, the function circuits can be easily constructed by employing the C-MOS technology, and the display device, since it can be put to use to display functions as well as time, is capable of being utilized in a so-called multi-function timepiece. Many proposals have been made in this area, and the production of such timepieces has gone forward.

However, in multi-function timepieces where a number of supplementary functions have been added to the principle time and calendar functions, numerous control operations were required for changing over among displays, selecting functions, correcting and setting data, controlling functions, and the like. Moreover, as all of these operations has to be performed by means of 3 or 4 control buttons, inevitably a number of control functions were accomplished through the use of a single control button. As a result, contradictions in use often arose between respective control button operations, and a user, owing to the complicated control system, did not know how to correctly operate the available functions and was likely to disrupt, by means of an erroneous operation, the time-keeping information which constitutes the main function of a timepiece. For example, in the case of functions such as alarm or timer functions which accompany the setting of numerical values related to time or a time-interval, setting the numerical values and correcting the time-keeping data of the time-keeping function are performed by the same operation; hence, although it is preferable that the same control button be employed for both operations, contradictions in use arise when controlling the above-mentioned two functions. In other words, setting the time in the alarm function is performed several times daily and so it follows that this particular operation should be made as easy to accomplish as possible. On the other hand, a time correction of the time-keeping function had to be made somewhat more difficult in order to prevent accidental operation. Accordingly, this could not be accomplished by a single button in the prior art regardless of the identical nature of the above-mentioned operations. As a consequence, individual control buttons were installed and the control buttons for time corrections were recessed into the watch case in order to prevent accidental operation.

In multi-function timepieces where a number of supplementary functions have been added to the principle time and calendar functions, problems have arisen related to a system of control members for controlling the functions and with regard to the display system for each of the functions. In particular, in order for a user to make the best use of each of the available functions, he must clearly be able to recognize the relationships among such displayed functions as a selected function display at a time when respective functions are in a mode where they can be controlled, or an operating function display for displaying supplementary functions which are in an operating state at the same time that the display device is in the main function display state.

SUMMARY OF THE INVENTION

It is, therefore, an object of the present invention to provide an electronic timepiece equipped with a correction and control system arranged to permit the use of a minimum number of control buttons while providing an ease of control switch operation.

It is another object of the present invention to provide an electronic timepiece equipped with a correction and control system in which a control switch is commonly used and erroneous operations can be prevented.

It is a further object of the present invention to provide a muli-function timepiece equipped with a simple display which shows the relationships among functions in a distinct manner.

It is a still further object of the present invention to provide a multi-function timepiece equipped with a simple display in which function display marks are jointly used as a selected function display, set function display, and operating function display in each of the different display modes to provide a distinct recognition of the functional state of the timepiece.

It is a still further object of the present invention to provide an electronic timepiece having a digital display device for displaying time, and a number of functions which make joint use of the digital display device, and which is characterized in that the digital display device is equipped with a number of function display marks corresponding to respective functions, wherein the digital display device permits the display of function display marks corresponding to the functions which have been placed in an operating state when the timepiece is in the time display mode, and permits a display of only those display marks corresponding to a given function in a selected state when the timepiece is in the function selection mode where respective functions can be set or controlled.

BRIEF DESCRIPTION OF THE DRAWINGS

These and other, objects, features and advantages of the present invention will become more apparent from the following description when taken in conjunction with the accompanying drawings, in which.

DESCRIPTION OF THE PREFERRED EMBODIMENT

A description of an embodiment of the invention will now be had with reference to the accompanying drawings. In the present embodiment, time and calendar functions will be taken as the main functions of a multi-function timepiece, and four functions, namely two alarm functions (ALM 1, ALM 2), a timer function (TIMER) and time signal function (T-BELL) will be adopted as the supplementary functions.

Figure 1:
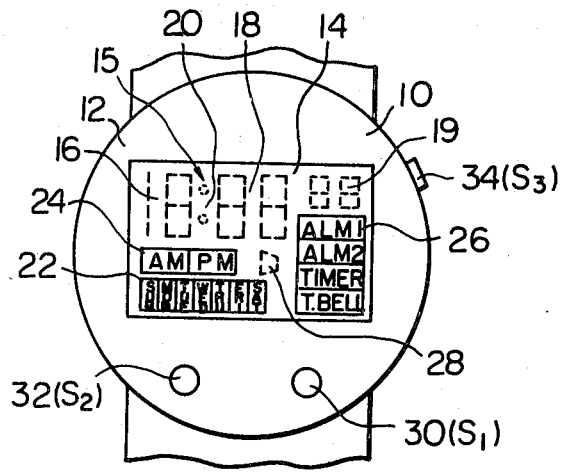
FIG. 1 is an external view of an electronic timepiece in accordance with the present invention.

With reference to FIG. 1 which shows an external view of a multifunction timepiece in conformance with the invention, reference numeral 10 denotes an electronic timepiece, 12 a case and 14 a digital display device comprising liquid crystal display means. Digital display device 14 includes a first display station 15 composed of a 1st display section 16 having a number of numerical display patterns, a 2nd display section 18, 3rd display section 19, and colon 20, a second or day of the week display station 22, a third or AM-PM display station 24, a fourth or function display station 26, and set mark 28. The day of the week display station 22, AM-FM display station 24, and function display station 26 constitute character displays that are printed on the reflective surface of the liquid crystal display means. In other words, a display system is formed in which, as the need arises, a small pattern covers the respective characters that indicate Sunday, Monday, Tuesday, Wednesday, Thursday, Friday and Saturday in the day of the week display station 22, AM and PM in the AM-PM display station 24, and (ALM 1) which represents the 1st alarm, (ALM 2) which represents the 2nd alarm, (TIMER) which represents the timer, and (T-BELL) which represents the time signal, in the function display station 26.

Reference numerals 30, 32 and 34 denote external control members such as buttons for controlling the functions of the timepiece; 30 is a principle setting button S1 which serves as a correction to set the numerical values of each display section, 32 is a digit selection button S2 for selecting the digits to be set by button S1, and 34 is a function selection button S3 for selecting each of the functions.

Figure 2:
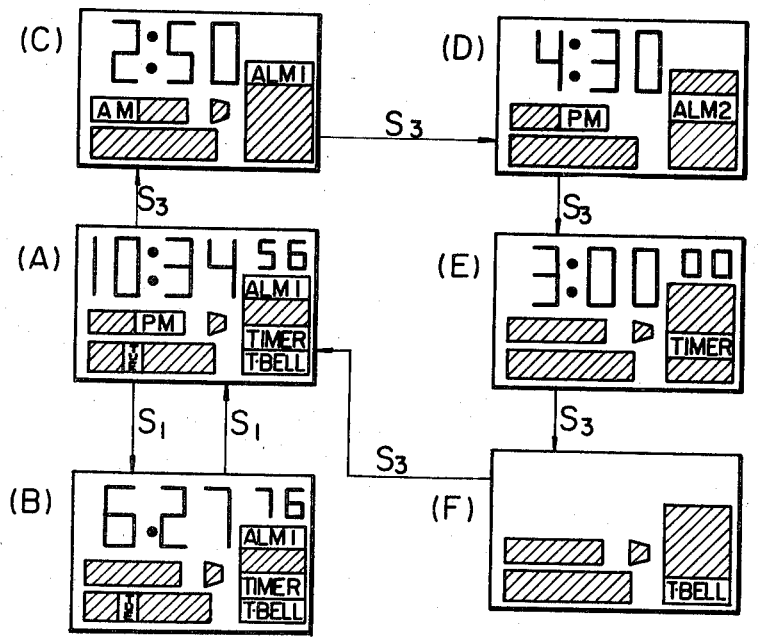
FIGS. 2, 3 and 4 show the display states of a digital display device shown in FIG. 1.

FIG. 2 shows the display states of the respective function selection modes of digital display device 14 as controlled by the control members. Taking the selection of the functions in order, (A) represents the time display mode in which the hours information displayed in the 1st display section 16, minutes information in the 2nd display section 18 and seconds information in the 3rd display section 19 indicate 10 hours, 34 minutes and 56 seconds. PM is displayed in the AM-PM display station 24 and Tuesday in the day of the week display station 28. Further, as will be described hereafter function display station 26 and set mark 28 display the fact that (ALM 1), (TIMER) and (T-BELL) are in the operating states.

(B) represents the calendar display mode in which months information displayed in the 1st display section 16, date information in the 2nd display section 18 and last two digits of years information is the 3rd display section 19 indicate June 27, 1976. The AM-PM display station 24 is blank as this information is unnecessary. The function display made up of function display station 26 and set mark 28 remains the same as in the above-mentioned time display mode (A). Switching between mode (A) and mode (B) is accomplished by manipulating button S1.

(C), (D), (E) and (F) represent the 1st alarm selection mode, 2nd alarm selection mode, timer selection mode and time signal selection mode, respectively. These modes are selected sequentially, beginning with time display mode (A), by manipulating button S3.

In the alarm selection modes, hours information, and minutes information is displayed in respective 1st display section 16, and 2nd display section 18; 3rd display section 19 and the day of the week display section 22 are blank as this information is unnecessary. With regard to function display section 26, there is a display of a function display mark corresponding solely to the function which is actually in the selected state, as ALM 1 in the (C) mode and ALM 2 in the (D) mode. The set mark 28, by means of an operation to be described later, is lit only when the selected function has actually been placed in the set state.

In the timer selection mode (E), hours information, minutes information and seconds information is displayed in respective 1st display section 16, 2nd display section 18 and 3rd display section 19; the AM-PM display station 24 and day of the week display station 22 are blank as this information is unnecessary. In function display station 26, only the display mark "TIMER" is displayed which is indicative of the timer function.

In the time signal selection mode (F), only the mark T-BELL, indicative of the time signal function, is displayed in the function display station 26. All other display sections are blank except for set mark 28 which is selectively displayed by an operation to be described later.

A description will now be had with respect to the setting and correction operations which accompany the manipulation of the control buttons in each of the respective modes.

Figure 3:
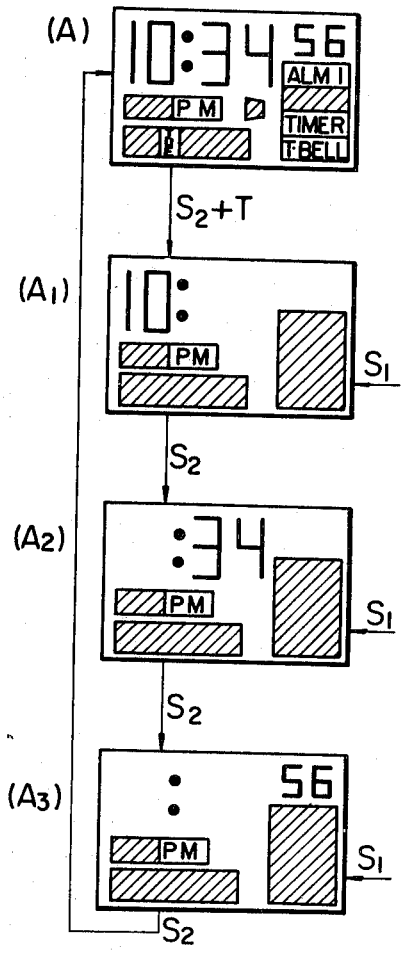

FIG. 3 illustrates the time correction states which occur in the time display mode (A). In this mode, a shift is made to a time correction mode (A1) by means of a timer T whenever digit selection button S2 is held depressed for a given period of time. Day of the week display station 22, function display station 26 and set mark 28 all attain a state of nondisplay, indicating that the timepiece is in a time correction state while simultaneously displaying the hours information contained in the 1st display section 16. In this state, the hours information displayed in the 1st display section 16 is corrected by the circuitry associated with button S1 whenever it is depressed. After this time information has been corrected to the desired value, depressing button S2 once brings about a shift to a minutes correction mode (A2) where the minutes information is displayed in the 2nd display section 18. In this state, the minutes information displayed in the 2nd display section 18 is corrected by the circuitry associated with button S1 whenever it is depressed. Next, depressing button S2 selects the seconds correction mode (A3) where the seconds information is displayed in the 3rd display section 19. In this state, the seconds information is reset to "00" when button S1 is depressed. Next, by depressing button S2, the timepiece is returned to the time display mode (A), thereby completing one time correction operation. It should be noted that the calendar correction in the calendar display mode (B) is accomplished in entirely the same manner.

Figure 4:
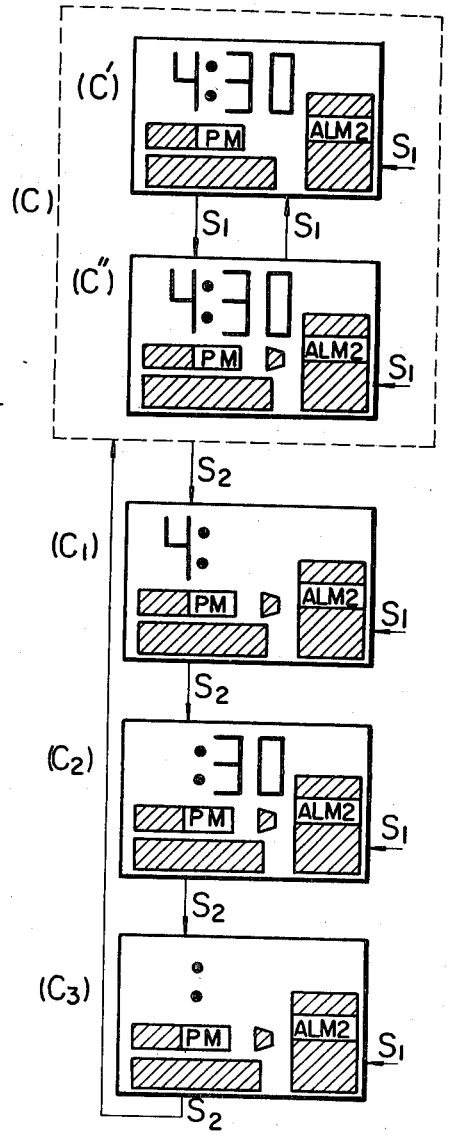

With reference to FIG. 4, the system in which the functions and the operating times are set in the alarm function mode will be described.

The 1st alarm selection mode (C) includes two states, namely an alarm function resetting state (C') and an alarm function setting state (C''). In the resetting state (C'), depressing button S1 selects the setting state C'', brings the set mark 28 to the display state, and sets the 1st alarm function. When button S1 is depressed while the timepiece is in the setting state (C''), the resetting state (C') is restored and the set mark 28 is distinguished thereby resetting the 1st alarm function. In other words, it is possible to select between the setting and resetting of the alarm function by depressing button S1 when in the alarm selection mode, and the function mark corresponding to the alarm function in the setting state will be displayed in function display section 26 when the timepiece is in the time display mode (A).

When button S2 is depressed with the timepiece in the 1st alarm selection mode (C), the hour setting mode (C1) is selected and the 1st display section 16 attains a display state. In this state, the alarm time hour data is st in the 1st display section 16 by the switch S1 when this button is depressed. Next, depressing button S2 selects the minute setting mode (C2) and brings the 2nd display section 18 to a state of display. The minute information can be set by means of button S1. In the same way the second setting mode (C3) is selected and the seconds information is set. When this has been performed, the timepiece is returned to the (C) mode by depressing button S2, thereby completing the setting operation of the 1st alarm function.

The respective setting operations in the 2nd alarm selection mode (D) are performed in a manner identical to that just described. Further, in the timer selection mode (E) the setting of the timer information in the 1st, 2nd and 3rd display sections 16, 18 and 19 is accomplished in the same manner as was the alarm timing, i.e., by means of buttons S2 and S1. In addition, the timer is started and stopped in an alternative manner by manipulating switch S1 when the timepiece is in the (E) mode. Furthermore, as yet to be described timer circuit is started by button S1 and intermittently performs a counting operation during which the function mark TIMER is displayed in function display section 26 while the timepiece is in the time display mode (A).

When button S1 is depressed with the timepiece in the time signal selection mode (E), setting and resetting of the time signal function is alternatively selected. In the setting state, set mark 28 is displayed and the function mark T-BELL is displayed in the function display station 26 when the timepiece is in the time display mode (A).

The setting operation of each of the above-mentioned functions will be described once again with reference to FIG. 2.

First, with the timepiece in the time display mode (A), depressing button S3 addresses the 1st alarm selection mode (C) and sets the alarm function to 2:50 AM. Next, depressing button S3 addresses, but does not set, the 2nd alarm function mode (D). The next operation of S3 addresses the timer selection mode (E) and, after the timer interval has been set to 3 hours, the timer is started by depressing button S1. Depressing S3 then addresses the time signal selection mode (E) which is then set. Following this, the timepiece is returned to the time display mode (A) by S3. As a consequence of these operations, the functions established by a single set of function setting operations, namely the function marks corresponding to the three functions ALM1, TIMER and T-BELL, are displayed in the function display section 26 when the timepiece is in the mode (A). In addition, when the time becomes 2:50 AM, the 1st alarm function will come into operation and emit an alarm, and a separate alarm will be generated by the timer function when three hours have elapsed from the set time. The time signal function will produce an alarm every hour on the hour. During each of these alarm periods, the function mark corresponding to the emitted alarm will experience a display modulation so as to exhibit a flashing display.

Figure 5:
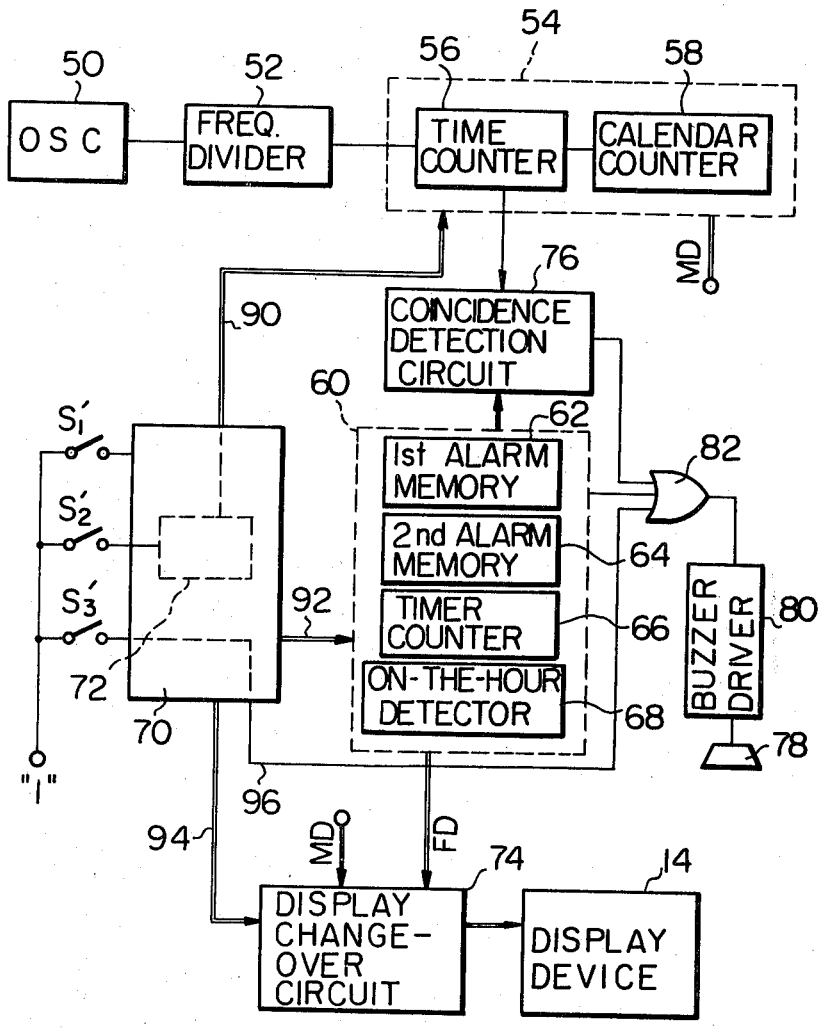
FIG. 5 is a block diagram of the electronic timepiece shown in FIG. 1.

FIG. 5 is a block wiring diagram showing the structure of the electronic timepiece illustrated in FIG. 1. Reference numeral 50 denotes a quartz controlled oscillator providing a relatively high frequency signal, 52 a frequency divider for dividing the relatively high frequency signal of oscillator 50 down to a low frequency signal, i.e., a time unit signal having a period of 1 second, and 54 designates a time-keeping circuit which comprises a time counter 56 composed of seconds, minutes and hours counters for producing time information signals such as seconds, minutes and hours signals, respectively, in response to the time unit signal, and a calendar counter 58 composed of days of the week counter, dates counter, months counter and years counter for producing calendar information signals such as days of the week, dates, months and years information signals. Reference numeral 60 denotes a supplementary function circuitry which is comprised of a 1st alarm memory 62, 2nd alarm memory 64, timer counter 66, and on-the-hour detection circuit 68. Reference numeral 70 designates a switching control circuit for controlling the function of switches S1', S2' and S3' responsive to manipulation of control buttons S1, S2 and S3. Reference numeral 72 denotes a delay timer T installed in control circuit 70, and 74 denotes a display change-over circuit which, responsive to instructions provided by control circuit 70, displays the information inputs and changes over among them. Reference numeral 76 designates a coincidence detection circuit for detecting coincidence between the output of counter 56 and that of the respective alarm memories 62, 64. Reference numeral 78 stands for a buzzer for producing an alarm, 80 a buzzer driver circuit for driving buzzer 78, and reference numeral 82 denotes an OR gate.

In the above arrangement, quartz controlled oscillator 50, frequency divider 52 and time-keeping circuit 54 together comprise a digital timepiece system as is widely known in the art. Control circuit 70 applies various data signals to time-keeping circuit 54 through lead 90 and supplementary function circuit 60 through lead 92 upon actuation of the switches. The data signals are also applied through lead 94 to display change-over circuit 74. This permits control of the above-mentioned display change-over, function selection, digit selection, correction and the various settings.

Supplementary function circuit 60 selects the respective function modes as instructed by control circuit 70. When the alarm function mode has been selected, coincidence between the time set in the alarm memories 62, 64 and the time in the time counter 56 causes the coincidence detection circuit 76 to generate a coincidence signal which is passed by OR gate 82 and renders buzzer driver circuit 80 operative so that buzzer 78 produces an alarm. When the timer function has been selected, an alarm is produced at the conclusion of the counting operation performed by timer counter 66. Further, when the time signal function has been selected, buzzer 78 issues an alarm whenever the content of time counter 56 is indicative of on-the-hour time information as detected by on-the-hour detection circuit 68. Display change-over circuit 74 receives main display information signal MD from time-keeping circuit 54 and function display information signal FD from supplementary function circuit 60 and, responsive to instructions from control circuit 70, displays and changes over the information on the digital display device 14.

As may be appreciated from FIG. 3, the delay timer 72 is rendered operative whenever switch S2' is depressed with the timepiece in the time display mode (A). After the elapse of a given period of time the time counter 56 is shifted to the time correction mode (A1) shown in FIG. 3.

For the function selecting operations shown in FIG. 2, an operating signal resulting from the closure of switch S'3 upon each manipulation of function selection button S3 is passed by OR gate 82 so as to drive buzzer 78; hence, it is possible to monitor the alarm sound.

Figure 6:
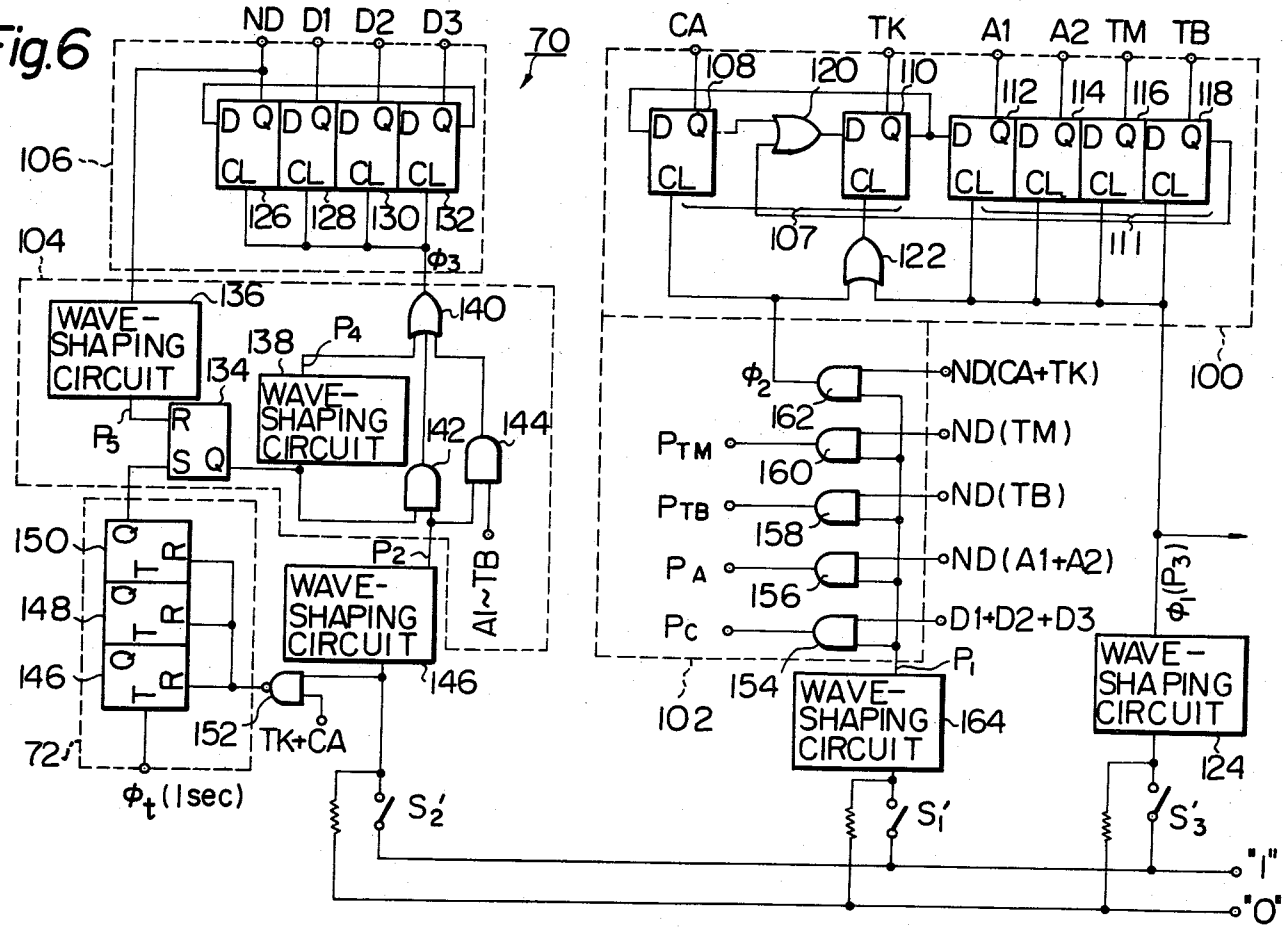
FIG. 6 is a preferred example of a control circuit shown in FIG. 5.

FIG. 6 shows a preferred example of the switch control circuit 70 shown in FIG. 5. The control circuit 70 comprises, in addition to the timer 72, a function selection circuit 100, a control signal generation circuit 102, an output signal generation circuit 104, and a digit selection circuit 106.

The function selection circuit 100 includes first and second shift registers 107 and 111 connected in series with one another. The first shift register 107 comprises a first data-type flip-flop 108, a second data-type flip-flop 110, and an OR gate 120 coupled between the first and second flip-flops 108 and 110. The data input terminal of the first flip-flop 108 is coupled to the Q output of the second flip-flop 110, and the data input terminal of the second flip-flop 110 is coupled through the OR gate 120 to the Q output of the first flip-flop 108. The clock input terminal of the first flip-flop 108 is coupled to the control signal generation circuit 102 to receive a clock pulse $\phi 2$ therefrom. The clock input terminal of the second flip-flop 110 is coupled through an OR gate 122 to the control circuit 102 and a waveform shaping circuit 124 to respond to clock pulses $\phi 2$ or $\phi 1$. With this arrangement, the first flip-flop 108 generates at its output a calendar function selection signal CA, and the second flip-flop 110 generates at its output a time-keeping function selection signal TK. Consequently, the first shift register 107 alternately generates, the output signals CA and TK is response to clock pulses $\phi 2$. Similarly, the second shift register 111 comprises a plurality of data-type flip-flops 112 to 118 connected in series with one another. The flip-flops 112 to 118 have their clock input terminals coupled to the waveshaping circuit 124 to receive the clock pulse $\phi 1$ therefrom when the function selection switch S'3 is actuated, to generate first alarm function selection signal A1, second alarm function selection signal A2, timer function selection signal TM, and time signal function selection signal TB, respectively.

The digit selection circuit 106 includes a shift register composed of data-type flip-flops 126 to 132 connected in series. The function selection circuit 106 is responsive to a clock pulse $\phi 3$ delivered from the output signal generation circuit 104 so that the flip-flops 126 to 132 produce a normal display signal ND, a first digit display signal D1, a second digit display signal D2, and a third digit display signal D3, respectively.

The output signal generation circuit 104 comprises an R-S type flip-flop 134 having its set terminal connected to an output of the timer 72, a reset terminal coupled through a waveshaping circuit 136 to the output of the flip-flop 126 of the function selection circuit 106, and its Q output coupled through a waveshaping circuit 138 and a first input of an OR gate 140 which generates the clock pulse $\phi 3$. The function selection signal generation circuit also comprises first and second AND gates 142 and 144. The first AND gate 142 has its first input coupled to the Q output of the flip-flop 134 and its second input coupled to the digit selection switch S'2 through a waveshaping circuit 146, and an output coupled to a second input of the OR gate 140. The second AND gate 144 has its one input coupled to the output of the waveshaping circuit 146 and its another input coupled to the second shift register 111 of the function selection circuit 100 to receive the function selection signals A1, A2, TM and TB. Outputs of the first and second AND gates 142 and 144 are coupled to other inputs of the OR gate 140.

The timer 72 comprises three toggle-type flip-flops 146 to 150 having reset terminals coupled to an output of a NAND gate 152. The NAND gate 152 has its one input coupled to the digit selection switch S'2 and another input coupled to the function selection circuit 100 to receive the calendar function selection signal CA and the time-keeping function selection signal TK therefrom. An input of the timer is connected to the frequency divider to receive a train of clock pulses $\phi t$ having the frequency of one second.

The control signal generation circuit 102 comprises a plurality of AND gates 154 to 162 having their first inputs coupled through a waveshaping circuit 164 to the correction switch S'1. A second input of the AND gate 154 is connected to the digit selection circuit 106 to receive the digit selection signals D1, D2 and D3 so that the AND gate 154 is opened in a case where one of the digit selection signals D1, D2 and D3 is generated i.e., in a time correction state of the time-keeping function or in a time setting state of the alarm function (FIGS. 3 and 4), to produce correction pulses in response to an input signal P1 generated by the waveshaping circuit 164. A second input of the AND gate 156 is connected to the digit selection circuit 106 and the function selection circuit 100 so that the AND gate 156 is opened both when the digit selection circuit 57 generates the normal display signal ND and when the function selection circuit 100 generates the alarm function signals A1 or A2 ((C) in FIG. 4), to generate an alarm set signal PA in response to the input signal P1. Likewise, the AND gate 158 is opened when the logical product of ND(TB) goes to a high level, to produce an on-the-hour set signal $P_{TB}$ in response to the input signal P1. The AND gate 160 is opened when the logical produce of ND(TM) goes to a high logic level, to produce a timer control signal $P_{TM}$. The AND gate 162 is opened when the logical product of ND(CA+TK) goes to a high level, to produce the clock pulse $\phi 2$ in response to the input signal P1.

A description will now be given for the operation of the circuit shown in FIG. 6 with respect to the time correction mode in the time-keeping function or the calendar function. Since the function selection circuit 100 normally generates the time-keeping function selection signal TK or the calendar function selection signal CA, the NAND gate 152 is opened while the AND gate 144 is inhibited. Since, in this case, the switch S'2 is opened, the output of the NAND gate 152 is at a high logic level and the timer 72 remains in its reset condition. Under this condition, the output of the flip-flop 150 of the timer 72 is at a low logic level, and the output of the flip-flop 134 of the digit selection signal generation circuit 104 is at a low logic level. Thus, the AND gate 142 is inhibited. Under these circumstances, if the switch S'2 is actuated, the inputs of the NAND gate 152 and the waveshaping circuit 146 go to a high logic level. As a result, the waveshaping circuit 146 generates an output pulse P2. However, since the AND gates 142 and 144 are inhibited, the output pulse P2 is not applied to the OR gate 140. On the other hand, the output of the NAND gate 152 goes to a low logic level while the switch S'2 is opened and, therefore, the reset condition of the timer 72 is released. Accordingly, the timer 72 begins to count the train of clock pulses $\phi t$ of one second period. When this timer counts four pulses $\phi t$, i.e., after four seconds from the actuation of the switch S'2, the output of the flip-flop 150 of the timer 72 goes to a high logic level, to generate an output signal. If, in this instance, the actuation time period of the switch S'2 is less than four seconds, all of the flip-flops 146 to 150 of the timer 72 are reset before the flip-flop 150 generates an output and, therefore, an output signal is not generated by the timer 72. As previously noted, the output signal generated by the timer 72 is applied to the set terminal of the flip-flop 134 of the digit selection signal generation circuit 104. In this case, the flip-flop 134 is set, to produce an output signal to cause the AND gate 142 to open and cause the waveshaping circuit 138 to provide an output P4. The P4 signal is applied through the OR gate 140 to the clock input terminals of the flip-flops 126 to 132 of the digit selection circuit 106, which is shifted by one step so that output signal D1 is produced. In this instance, the first display section 16 is brought to a correction mode. If the switch S'2 is actuated a second time, the waveshaping circuit 146 generates an output signal P2 which is applied through the AND gate 142 to the digit selection circuit 106 which is consequently shifted by one step. In this manner, the output signals D2 and D3 are generated each time the switch S'2 is actuated. If the switch S'2 is actuated again after the output signal D3 has been produced, the digit selection circuit 106 generates an output signal ND by which the display device is brought into its normal display mode. This output signal is applied to the waveshaping circuit 136, which generates an output pulse which is applied to the reset terminal of the flip-flop 134. Thus, the flip-flop 134 is reset and the Q output goes to a low logic level, thereby inhibiting the AND gate 142 so that the correction mode is completed.

A time setting mode in another function will be selected in a manner as will be described below. Since one of the output terminals A1 to TB of the function selection circuit 100 is at a high logic level, the AND gate 144 is opened and the NAND gate 87 is inhibited. Accordingly, the output signal P2 generated by the waveshaping circuit 146 upon each actuation of the switch S'2 is applied through the AND gate 144 and the OR gate 140 to the digit selection circuit 106, which is consequently shifted to provide output signals D1, D2, D3 and ND in a cyclic manner in response to the output signals $\phi 3$. If the switch S'1 is actuated when one of the digit selection signals D1 to D3 is generated, the waveshaping circuit 164 generates an output signal P1. Since, in this condition, the AND gate 154 is opened to convert the output signal P1 to an output signal or correction signal Pc which is applied through lead 92 to the supplementary function circuitry 60 to allow setting of data therein.

The relationship between the output signals generated by the control circuit 70 and leads 90, 92 and 94 to which these output signals are directed is indicated in the following Table:

Table

| Output signals | Lead |
|---|---|
| CA,TK,ND,D1,D2,D3,Pc | 90 |
| A1,A2,TM,TB,ND,D1,D2 D3,$P_{TM}$,$P_{TB}$,PA,Pc | 92 |
| ND,D1,D2,D3,CA,TK,A1 A2,TM,TB,$P_{TB}$, $P_A$ | 94 |

It will be appreciated that the control circuit of FIG. 6 makes it possible to render the timer 72 to be operative only when the digit selection circuit 106 is shifted to the correction mode during the time-keeping function or the calendar function and after one digit has been selected another digit can be directly selected by the actuation of the switch S'2. Therefore, the digit selection circuit 106 is not operative until the switch S'2 is actuated for a prescribed time interval. Thus, it is possible to avoid undesired time correction caused by inadvertent actuation of the switch S'2 for a short period. Since, in this manner, the control circuit 70 is constructed so as not to generate digit selection signals until the switch S'2 is actuated for a prescribed time interval, it is possible to have the watch equipped with a protruding type button which is easy to manipulate.

In accordance with the invention as described above, it is possible to make common use of control buttons and at the same time prevent the accompanying erroneous operations which were a problem in conventional multi-function timepieces. Thus, by consolidating the operational functions of the respective control buttons, control switch operation can be made more understandable and costs can be lowered through reducing the number of buttons.

In accordance with the invention further, the function display marks are used jointly as a selected function display, established function display and operating function display in each of the display modes so that, regardless of the simple construction, an individual wearing the timepiece can distinctly recognize the functional state. The present invention thus is effective in enhancing the commercial value of multi-function timepieces.

What is claimed is:

1. A multi-function electronic timepiece which operates in a time-keeping function mode and a plurality of secondary function modes, comprising:

a frequency standard providing a relatively high frequency signal;

a frequency divider providing a time unit signal in response to said relatively high frequency signal;

time-keeping circuit means responsive to said time unit signal for providing time information signals;

a function circuit including a plurality of circuit means for performing said plurality of secondary functions and for providing function display signals;

display means including a time display station for displaying time information in response to said time information signals, and a plurality of function display marks for displaying said plurality of secondary functions, respectively, in response to said function display signals;

a manually operable switch for providing an output pulse when actuated;

a control circuit including means responsive to said output pulse for generating an output signal indicative of a state in which a selected one of said plurality of circuit means is in a controllable state; and display change-over circuit means for passing said time information signals and said function display signals to said display means in said time-keeping function, whereby said time display station is operative to display said time information and said plurality of function display marks are effective to indicate that said plurality of secondary functions are set, in said time-keeping function mode; said display change-over circuit being responsive to said output signal from said control circuit whereby only one of said plurality of function display marks corresponding to the circuit means in said selected state is effective to indicate when said selected one of said plurality of circuit means is in the controllable state.

2. In a multi-function electronic timepiece which operates in a time-keeping function mode, a calendar function mode and secondary function modes other than said time-keeping function and said calendar function modes comprising a frequency standard providing a relatively high frequency signal, a frequency divider providing a time unit signal in response to said relatively high frequency signal, a time-keepting circuit responsive to said time unit signal to provide time information signals and a calendar information signal, a function circuit including a plurality of circuit means for providing secondary function mode signals to operate the timepiece in the secondary function modes, display means including a first display station composed of a plurality of display sections both for displaying time information in response to said time information signals and for displaying secondary function modes in response to said secondary function mode signals, a function selection switch to provide a first output when actuated, a digit selection switch to provide a second output when actuated, and a correction switch for providing a third output to effect inputting of data into said time-keeping circuit and said function circuit when actuated, the improvement comprising:

function selection circuit means for normally providing a time-keeping mode selection signal to operate said display means to display said time information in said time-keeping function mode and responsive to said first output for providing a function mode selection signal to select one of said secondary function modes;

a timer circuit connected to said digit selection switch for generating an output signal when said digit selection switch remains actuated for a predetermined time interval;

an output signal generation circuit including first circuit means for generating a first output pulse, to enable selection of digits to be set in said function circuit, in response to said function mode selection signal and said second output, and second circuit means for generating a second output pulse to enable selection of digits to be set in said time-keeping circuit, in response to said output signal from said timer circuit and said second output; and digit selection circuit means responsive to said first and second output pulses for selecting said digits to be set in said time-keeping circuit and said function circuit;

whereby the digits to be set in said time-keeping circuit are selected only when said digit selection switch is continuously actuated for the predetermined time interval whereas the digits to be set in said function circuit are selected even when said digit selection switch is actuated for a time period less than said predetermined time interval while said function selection switch is actuated.

3. The improvement according to claim 2, in which said first circuit means comprises gate means for being enabled only when said function mode selection signal is present.

4. The improvement according to claim 2, in which said second circuit means comprises gate means for being enabled only when said output signal from said timer circuit is present.

5. The improvement according to claim 2, in which said digit selection circuit means comprises a shift register composed of a plurality of flip-flops operative to select said digits in a cyclic manner in response to said output pulses from said output signal generation means.

6. The improvement according to claim 4, in which said second circuit means also comprises a flip-flop having a set terminal coupled to an output of said timer circuit, and an output terminal coupled to an input of said gate means of said second circuit means.

7. The improvement according to claim 2, in which said display means also includes a plurality of function display marks corresponding to said secondary function modes, and said display means being effective to display only those display marks corresponding to a given function in a selected state when said function selection switch is actuated to place the timepiece in a particular function mode.

8. The improvement according to claim 7, in which said function selection circuit means comprises first and second shift registers connected in series and responsive to said first output generated when said function selection switch is actuated.

9. The improvement according to claim 2, further comprising control signal generation circuit means having first inputs connected to said correction switch and second inputs connected to said digit selection circuit means and said function selection circuit means for generating control signals to control said function circuit in response to output signals from said digit selection circuit means for said function selection circuit means.

* * * * *